US010386791B2

(12) United States Patent
Tombez et al.

(10) Patent No.: US 10,386,791 B2
(45) Date of Patent: Aug. 20, 2019

(54) TIMEPIECE ASSEMBLY COMPRISING A MECHANICAL OSCILLATOR ASSOCIATED WITH A REGULATING DEVICE

(71) Applicant: The Swatch Group Research and Development Ltd, Marin (CH)

(72) Inventors: Lionel Tombez, Bevaix (CH); Alexandre Haemmerli, St-Blasie (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/832,909

(22) Filed: Dec. 6, 2017

(65) Prior Publication Data

US 2018/0181073 A1 Jun. 28, 2018

(30) Foreign Application Priority Data

Dec. 23, 2016 (EP) ..... 16206778
May 23, 2017 (EP) ..... 17172554

(51) Int. Cl.
*G04C 9/04* (2006.01)
*G04C 11/08* (2006.01)
(Continued)

(52) U.S. Cl.
CPC ..... *G04C 9/04* (2013.01); *G04C 3/04* (2013.01); *G04C 9/08* (2013.01); *G04C 11/084* (2013.01)

(58) Field of Classification Search
CPC ... G04C 9/04; G04C 3/04; G04C 9/08; G04C 11/084; G04C 3/047; G04C 3/08; G04C 10/00; G04C 11/00
(Continued)

(56) References Cited

U.S. PATENT DOCUMENTS 7,396,154 B2 * 7/2008 Houlon ..... G04C 5/005 368/127
7,686,503 B2 * 3/2010 Rochat ..... G04B 15/06 368/127
(Continued)

FOREIGN PATENT DOCUMENTS

EP 1 241 538 A1 9/2002

OTHER PUBLICATIONS

European Search Report dated Jun. 9, 2017 in European Application 16206778.9 filed on Dec. 23, 2016 (with English Translation of Categories of Cited Documents).

*Primary Examiner* — Edwin A. Leon
(74) *Attorney, Agent, or Firm* — Oblon, McClelland, Maier & Neustadt, L.L.P.

(57) ABSTRACT

A mechanical movement timepiece assembly with a mechanical oscillator is formed by a resonator of the balance-hairspring type, and a device for regulating the oscillation frequency thereof using an auxiliary oscillator equipped with a quartz resonator. The regulating device includes a sensor, suitable for detecting the passage of the resonator via the neutral position thereof, a measuring device suitable for measuring, on the basis of position signals supplied by the sensor, a time drift of the mechanical oscillator relative to the auxiliary oscillator, and a device for applying to the resonator mechanical braking pulses when a certain time drift is observed. For this purpose, the resonator has a braking surface which extends over at least a certain sector having a certain length along the oscillation axis and against which a braking member may press in order to momentarily brake the resonator.

25 Claims, 9 Drawing Sheets

(51) Int. Cl.
*G04C 3/04* (2006.01)
*G04C 9/08* (2006.01)

(58) Field of Classification Search
USPC ..... 368/160
See application file for complete search history.

(56) References Cited

U.S. PATENT DOCUMENTS

| | | | | |
|---|---|---|---|---|
| 8,534,910 | B2 * | 9/2013 | Baudet | G04C 5/005 368/126 |
| 2003/0137901 | A1 * | 7/2003 | Tokoro | G01C 9/06 368/127 |

* cited by examiner

TIMEPIECE ASSEMBLY COMPRISING A MECHANICAL OSCILLATOR ASSOCIATED WITH A REGULATING DEVICE

This application claims priority from European Patent Applications No. 16206778.9 filed on Dec. 23, 2016 and Ser. No. 17/172,554.2 filed on May 23, 2017, the entire disclosures of which are incorporated herein by reference.

TECHNICAL FIELD

The present invention relates to a timepiece assembly, particularly a precision timepiece, comprising:

- a mechanism, which forms particularly in part a mechanical movement,
- a mechanical resonator suitable for oscillating along an oscillation axis about a neutral position corresponding to the minimum potential mechanical energy state thereof,
- a device for maintaining the mechanical resonator forming with the latter a mechanical oscillator suitable for defining the working rate of the mechanism, each oscillation of the mechanical resonator exhibiting two successive alternations between two end positions on the oscillation axis defining the oscillation amplitude of the mechanical oscillator,
- a regulating device suitable for regulating the frequency of the mechanical oscillator, this regulating device comprising an auxiliary oscillator, generally more precise than said mechanical oscillator, and a device arranged for applying on demand regulation pulses to the mechanical resonator braking same momentarily.

In particular, the mechanical resonator is a balance-hairspring and the maintenance device comprises a conventional escapement, for example having a Swiss pallet assembly. The auxiliary oscillator is formed particularly by a quartz resonator or by a resonator integrated in an electronic circuit.

TECHNOLOGICAL BACKGROUND

Movements forming timepiece assemblies as defined in the field of the invention have been proposed in some prior documents. The patent CH 597 636, published in 1977, proposes such a movement with reference to FIG. 3 thereof. The movement is equipped with a balance-hairspring and a conventional maintenance device comprising a pallet assembly and an escape wheel kinematically linked with a barrel equipped with a spring. This timepiece movement comprises a device for regulating the frequency of the mechanical oscillator. This regulating device comprises an electronic circuit and a magnetic assembly formed from a flat coil, arranged on a support arranged under the felloe of the balance, and from two magnets mounted on the balance and arranged close to one another so as to both pass over the coil when the oscillator is activated.

The electronic circuit comprises a time base comprising a quartz generator and serving to generate a reference frequency signal FR, this reference frequency being compared with the frequency FG of the mechanical oscillator. The frequency FG of the oscillator is detected via the electrical signals generated in the coil by the pair of magnets. The regulating circuit is suitable for momentarily inducing a braking torque via a magnetic magnet-coil coupling and a switchable load connected to the coil. The document CH 597 636 provides the following teaching: "The resonator formed should have a variable oscillation frequency according to the amplitude on either side of the frequency FR (isochronism error)". It is therefore taught that a variation in the oscillation frequency of a non-isochronous resonator is obtained by varying the oscillation amplitude thereof. An analogy is made between the oscillation amplitude of a resonator and the angular velocity of a generator comprising a rotor equipped with magnets and arranged in a gear train of the timepiece movement in order to regulate the operation thereof. As a braking torque reduces the rotational speed of such a generator and as such the rotational frequency thereof, it is herein merely envisaged to be able to reduce the oscillation frequency of an obligatorily non-isochronous resonator by applying a braking torque reducing the oscillation amplitude thereof.

To perform electronic regulation of the frequency of the generator, or of the mechanical oscillator, it is envisaged in a given embodiment that the load is formed by a switchable rectifier via a transistor which loads a storage capacity during braking pulses, to retrieve the electricity so as to supply the electronic circuit. The consistent teaching given in the document CH 597 636 is as follows: When FG>FR the transistor is conductive; a power Pa is then drawn from the generator/oscillator. When FG<FR, the transistor is non-conductive; therefore, power is no longer drawn from the generator/oscillator. In other words, regulation is merely performed when the frequency of the generator/of the oscillator is greater than the reference frequency FR. This regulation consists of braking the generator/oscillator with the aim of reducing the frequency FG thereof. As such, in the case of the mechanical oscillator, those skilled in the art understand that regulation is only possible when the barrel spring is strongly armed and that the free oscillation frequency (natural frequency) is greater than the reference frequency FR, resulting from a voluntary isochronism error of the selected mechanical oscillator. Therefore, there is a two-fold problem, i.e. the mechanical oscillator is selected for that which is usually an error in a mechanical movement and the electronic regulation is only functional when the natural frequency of this oscillator is greater than a nominal frequency.

In conclusion, the teaching generally given to those skilled in the art is as follows: If it is sought to electronically regulate the frequency of a balance-hairspring of a conventional timepiece movement, it is necessary to change the balance-hairspring in order to firstly arrange at least one magnet on top and secondly to modify the natural frequency thereof such that this natural frequency is greater than the frequency sought. The consequence of such a teaching is obvious: It is necessary to misadjust the mechanical resonator so that it oscillates at an excessively high frequency so as to enable the regulation device to consistently return the frequency thereof to a lower frequency, corresponding to the theoretical frequency sought, by a succession of braking pulses. Consequently, the resulting timepiece movement is voluntarily set in such a way that precise operation is dependent on the electronic regulation, failing which such a timepiece movement would have a very significant time drift. As such, if for one reason or another the regulation device is deactivated, particularly due to damage, then the watch equipped with such a movement will no longer be precise, to an extent that it is actually no longer operational. Such a situation is problematic.

The use of a magnet-coil type electromagnetic system for coupling the balance-hairspring with the electronic regulation circuit gives rise to various problems. Firstly, the arrangement of permanent magnets on the balance results in a magnetic flux being consistently present in the timepiece movement and said magnetic flux varying spatially periodically. Such a magnetic flux may have a harmful effect on various members or elements of the timepiece movement, particularly on elements made of magnetic material such as parts made of ferromagnetic material. This may have repercussions on the proper operation of the timepiece movement and also increase wear of pivoted elements. It may indeed be envisaged to shield to a certain extent the magnetic system in question, but shielding requires specific elements which are borne by the balance. Such shielding tends to increase the size of the mechanical resonator and the weight thereof. Furthermore, it limits the possibilities of clean visually appealing configurations. Furthermore, a high-intensity external magnetic field may damage the magnetised elements of the electromagnetic system.

Those skilled in the art are aware of the proposed embodiments of mechanical timepiece movements, comprising a device for regulating the frequency of the balance-hairspring, where it is envisaged to act upon the oscillating balance with an electromechanical system formed, on one hand, by a stop which is arranged on the balance and, on the other, by an actuator equipped with a movable finger which is actuated at a defined braking frequency in the direction of the abutment. This concept is intended to synchronise the frequency of the oscillator against that of a quartz oscillator with a claimed interaction between the finger and the stop when the mechanical oscillator exhibits a time drift relative to the quartz oscillator, the finger either momentarily locking the balance which is then stopped in the movement thereof during a certain time interval (the stop bearing against the finger moved in the direction thereof upon the return of the balance towards the neutral position thereof), or limiting the oscillation amplitude when the finger arrives against the stop while the balance rotates in the direction of the maximum amplitude position thereof.

Such a regulation system has numerous drawbacks and it could seriously be doubted that it could form an operational system. The 'blind' action of the finger relative to the movement of the stop and to any potential initial phase shift of the oscillation of the stop in relation to that of the finger poses multiple problems. The action is limited to an angular position given by the position of the actuator relative to the balance-hairspring. As such, the effect of the interaction between the finger and the stop is dependent on the oscillation amplitude of the balance-hairspring and on the position of the actuator. In conclusion, such embodiments appear to a person skilled in the art to be highly unlikely, and such a person skilled in the art is deterred from such a use. Moreover, those skilled in the art of the present invention are not aware of watches equipped with such an electromechanical system that have been introduced onto the market.

SUMMARY OF THE INVENTION

An aim of the present invention is that of finding a solution to the technical problems and drawbacks mentioned above in the technological background.

A first aim, within the scope of the development leading to the present invention, was that of proposing a timepiece assembly comprising a mechanical movement, with a conventional balance-hairspring type mechanical resonator, and a regulating device which does not use a magnet-coil system for coupling the mechanical resonator to this regulating device, in particular which does not require arranging at least one permanent magnet on the balance. It shall be noted that, within the scope of the description of the present invention, such a magnet-coil system induces magnetic braking pulses, a magnetic flux generated by at least one coil being coupled with the magnetic flux of said at least one permanent magnet onboard the mechanical resonator.

A second aim, within the scope of the development resulting in the present invention, was that of producing a timepiece assembly comprising a mechanical movement with a mechanical oscillator and a device for regulating this mechanical oscillator, but without having to initially misadjust of the mechanical oscillator, in order to obtain a timepiece which has the precision of an auxiliary electronic oscillator (particularly equipped with a quartz resonator) when the regulating device is operational and the precision of the mechanical oscillator when this regulating device is deactivated or non-operational, but with a precision liable to correspond to the best standard in the latter case. In other words, it is sought to adjoin electronic regulation to a mechanical movement adjusted to the highest possible precision moreover such that it remains operational, with the best possible operation, when the electronic regulation is inactive.

The aim of the present invention is also that of proposing a timepiece assembly fulfilling at least the first aim and which is robust, i.e. which can retain a high precision even after an external disturbance such as a shock.

To this end, the present invention relates to a timepiece assembly as defined in claim 1, as well as to a regulating module as defined in claim 16. Diverse embodiments and variants are the subjet-matter of the dependent claims. Thus, the timepiece assembly according to the invention comprises an electronic control circuit, suitable for generating a control signal which is supplied to the regulation pulse application device for the activation thereof, and a sensor suitable for detecting the passage of the mechanical resonator via a certain given position on the oscillation axis. The regulating device of this timepiece assembly comprises a measuring device suitable for measuring, on the basis of position signals supplied by the sensor, a time drift of the mechanical oscillator relative to the auxiliary oscillator. Advantageously, the regulation pulse application device of the timepiece assembly is an electromechanical device suitable for generating, in response to the control signal mentioned above which is dependent on the time drift measured, mechanical braking pulses applied to the mechanical resonator, each applying a certain force couple to this mechanical resonator, to regulate the medium frequency of the mechanical oscillator, when at least a certain time drift of this mechanical oscillator is detected. Finally, the mechanical resonator defines a braking surface having a certain extent along the oscillation axis of the mechanical resonator and arranged in such a way as to enable at least the application of a mechanical braking pulse with the triggering thereof at a certain given time during an alternation, of the two alternations of an oscillation of the mechanical oscillator, regardless of the oscillation amplitude of this mechanical oscillator in an amplitude range having a certain extent and corresponding to a usable operating range of the mechanical oscillator, said given time being selected such that the passage via the neutral position of the mechanical resonator does not occur during the mechanical braking pulse.

The term 'mechanical braking pulse' denotes braking of mechanical nature and not merely a mechanical effect resulting from the braking. As such, this expression excludes in the first meaning assigned thereto contactless braking via an electromagnetic coupling between a stationary coil and at least one magnet mounted on the mechanical resonator, because in the latter case, the braking is magnetic and performed via an electromagnetic system wherein an element, i.e. said at least one magnet, is attached to an oscillating member of the mechanical resonator, thereby changing the conventional arrangement of the oscillating member, for example a balance. However, magnetic braking has the end result of reducing the mechanical energy of the oscillating member, but the braking is not mechanical in nature. The expression mentioned above also excludes braking resulting from electrical coupling between the oscillating member and a stationary unit of the regulating device. On the other hand, obviously, this expression does not exclude electrical and/or magnetic elements incorporated in the electromagnetic device which induces mechanical braking pulses applied to the mechanical resonator. On the other hand, the term 'electromechanical' indicates that at least one electrical element forms the regulation pulse application device.

In one preferred embodiment, the regulation pulse application device is formed by an actuator comprising at least one braking member suitable for being actuated, in response to the control signal mentioned above, so as to apply to the oscillating member of the mechanical resonator a certain mechanical force couple during the mechanical braking pulses. Braking is therefore obtained by physical contact between the braking member and the oscillating member.

In one advantageous alternative embodiment of the preferred embodiment mentioned above, the regulation pulse application device is arranged such that the braking energy of each mechanical braking pulse is less than a locking energy, so as not to stop the mechanical resonator momentarily during the braking pulses. Subsequently, the oscillating member and the braking member are arranged such that the mechanical braking pulses can be applied essentially by dynamic dry friction between the braking member and the braking surface of the oscillating member.

By means of the features of the invention, it is possible to adjoin to a basic mechanical movement a module for regulating the mechanical oscillator thereof (comprising a balance-hairspring) without having to modify this basic mechanical movement. This is a great advantage. In particular, the timepiece assembly according to the invention may be produced without having to vary the kinematic properties of the mechanical oscillator. If required, a surface treatment (generally partial) of the balance may be envisaged for the operation of the sensor. Such a treatment may be limited to affixing a black dot on one of the balance or under the felloe of said balance in the case of an optical sensor. As such, the design of the basic mechanical movement does not need to be changed to produce a timepiece assembly according to the invention. In a first case where the timepiece assembly is produced entirely as new, it is therefore possible to take an existing template having proven its worth in production and associate therewith an additional regulation module according to the invention, by arranging at the periphery of the timepiece movement corresponding to this template the regulating module so as to enable the application of the mechanical braking pulses to the mechanical resonator. At the exterior of the timepiece assembly, it will optionally be necessary to envisage an adaptation to enable the incorporation of the additional regulating module. In a second case, the timepiece assembly according to the invention is formed by a basic timepiece movement placed, firstly, on the market in a watch and to which is added, secondly, a regulating module according to the invention in order to increase the precision thereof. An adaptation at the exterior of the watch may prove to be necessary, but is not necessarily obligatory. For example, machining at a casing ring may prove to be sufficient to enable the incorporation of the timepiece assembly in the case already in a user's possession, i.e. with an addition of a regulating module according to the invention, the subject matter of the appended claims.

According to one main embodiment, the measuring device is suitable for determining whether the time drift of the mechanical oscillator corresponds to at least one advance or to at least one delay. Subsequently, the control circuit and the regulation pulse application device are suitable for selectively applying to the mechanical resonator, when the time drift measured corresponds to a certain advance, a first mechanical braking pulse wherein at least a main part occurs between the initial time and the median time of an alternation (first half-alternation) and, when the time drift measured corresponds to a certain delay, a second mechanical braking pulse wherein at least a main part occurs between the median time and the end time of an alternation (second half-alternation). It shall be noted that each oscillation period of the mechanical oscillator defines a first alternation followed by a second alternation and each alternation has a passage of the mechanical resonator via the neutral position at said median time.

As such, in sum, the control circuit and the regulation pulse application device are suitable for selectively applying to the mechanical resonator, when the time drift measured corresponds to a certain advance, a mechanical braking pulse in a first half-alternation of the oscillation of the mechanical resonator and, when the time drift measured corresponds to a certain delay, a mechanical braking pulse in a second half-alternation.

In a main alternative embodiment, the regulating device comprises a device for determining time positions of the mechanical resonator which is suitable for determining, in an alternation of an oscillation of the mechanical resonator, a first time which occurs prior to the median time and after the initial time of this alternation and, also in an alternation of an oscillation of this mechanical resonator, a second time which occurs after the median time and prior to the end time of this alternation. Subsequently, the control circuit is suitable for selectively triggering a first mechanical braking pulse substantially at the first time and a second mechanical braking pulse substantially at the second time. Finally, the braking surface of the mechanical resonator comprises a first sector, along the oscillation axis thereof, for applying the first mechanical braking pulse starting substantially at the first time and a second sector, along the oscillation axis, for applying the second mechanical braking pulse starting substantially at the second time, regardless of the oscillation amplitude of the mechanical oscillator in the usable operating range thereof.

BRIEF DESCRIPTION OF THE FIGURES

The invention will be described in more detail hereinafter using the appended drawings, given by way of examples that are in no way limiting, wherein.

DETAILED DESCRIPTION OF THE INVENTION

Figure 1:
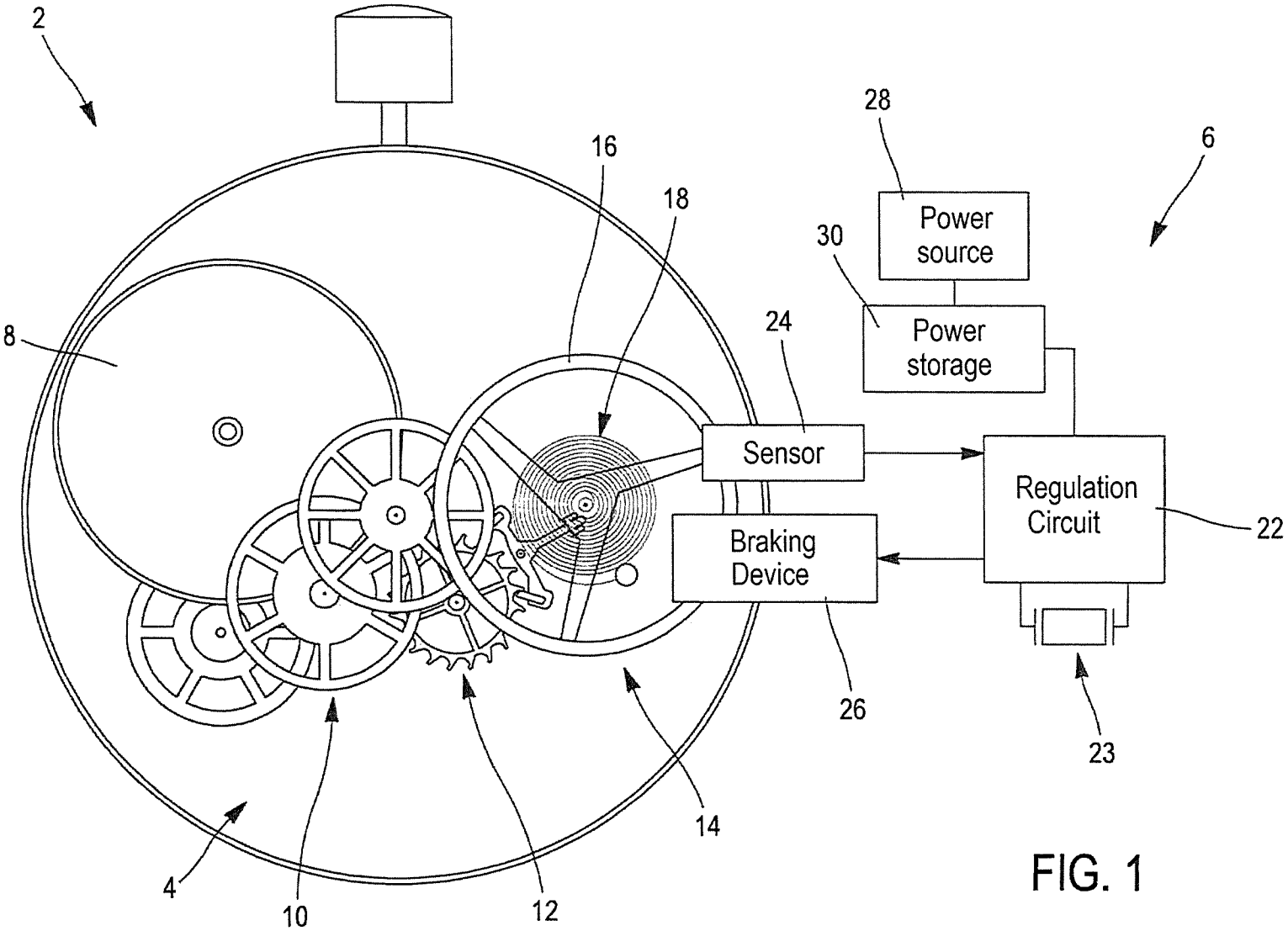
FIG. 1 is a top view of a timepiece assembly according to the invention.

In FIG. 1, a timepiece assembly 2 according to the present invention is represented. It comprises a mechanical timepiece movement 4 which is formed at least by a mechanism comprising a gear train 10 actuated by a mainspring arranged in a barrel 8 (this mechanism is represented partially in FIG. 1). The timepiece movement comprises a mechanical resonator 14, formed by a balance 16 and a hairspring 18, and a device for maintaining the mechanical resonator forming with this mechanical resonator a mechanical oscillator which controls the operation of the mechanism. The maintenance device comprises an escapement 12, formed herein by a pallet assembly and an escape wheel which is kinematically linked with the barrel via the gear train 10. The mechanical resonator is suitable for oscillating along an oscillation axis, in particular a circular axis, about a neutral position corresponding to a minimum potential mechanical energy state. Each oscillation of the mechanical resonator defines an oscillation period.

The timepiece assembly 2 further comprises a device 6 for electronically regulating the frequency of the mechanical oscillator, this regulating device comprising an electronic regulation circuit 22 associated with an auxiliary oscillator formed by a quartz resonator 23. It should be noted that other types of auxiliary oscillators may be envisaged, particularly an oscillator integrated entirely in the regulation circuit. By definition, the auxiliary oscillator is more precise than the mechanical oscillator. The device 6 also comprises a sensor 24 for detecting at least one angular position of the balance when it oscillates and a device 26 for applying regulation pulses to the mechanical resonator 14. Finally, the timepiece assembly comprises a power source 28 associated with a device 26 for storing the electricity generated by the power source. The power source is for example formed by a photovoltaic cell or by a thermoelectric element, these examples being in no way limiting. In the case of a battery, the power source and the storage device form together one and the same component.

As a general rule, the regulating device 6 comprises in the regulation circuit thereof an electronic control circuit suitable for generating a control signal, which is supplied to the regulation pulse application device which is suitable for generating, in response to this control signal, successive regulation pulses each applying a certain force couple to the mechanical resonator. According to the invention, the sensor 24 is suitable for detecting the passage of at least one reference point of the balance 16 via a certain given position relative to a support of this mechanical resonator. Preferably, the sensor is suitable for detecting at least the passage of the mechanical resonator via the neutral position thereof. It should be noted that, in this preferred alternative embodiment, the sensor may be associated with the escapement pallet assembly so as to detect the switching of this pallet assembly during the oscillation maintenance pulses envisaged substantially when the resonator passes via the neutral position thereof.

The detection of the neutral point of the resonator makes it possible to generate a usable and stable time reference within the oscillations. Indeed, in the absence of disturbances (particularly induced by the braking pulses envisaged for regulation), the passage via the neutral point always occurs exactly at the midpoint of the alternations, independently of the oscillation amplitude. On the other hand, the detection of another angular position of the balance does not give a stable and clearly defined time reference, particularly relative to the events such as the passage of the balance-hairspring via the neutral position thereof and the start or end of the alternations, i.e. the times where the balance is at maximum amplitude and at zero angular velocity (corresponding to the inversion of the oscillation direction). Furthermore, as the angular velocity of the balance-hairspring is maximum upon the passage thereof via the neutral position thereof, the precision of this detection and as such that detection of the corresponding time are superior. The benefit of detecting the passage of the balance-hairspring via the neutral position thereof will be clearly understood hereinafter during the disclosure of the preferred regulation method given with reference to FIGS. 3 and 4, and of the embodiments that follow.

As a general rule, the regulating device 6 also comprises a measuring device suitable for measuring, on the basis of position signals supplied by the sensor, a time drift of the mechanical oscillator relative to the auxiliary oscillator. It is understood that such a measurement is easy once a sensor capable of detecting the passage of the mechanical resonator via the neutral point thereof is provided. Such an event takes place every oscillation half-period of the mechanical oscillator. The measurement circuit will be described in more detail hereinafter.

The regulation pulse application device 26 is suitable for applying to the balance 16 mechanical braking pulses for regulating the frequency of the mechanical oscillator when a certain time drift of said mechanical oscillator is observed. In one particular alternative embodiment, the braking energy drawn from the mechanical resonator by any mechanical braking pulse is envisaged to be less than the locking energy of the mechanical oscillator, so as not to momentarily stop the oscillation movement of the mechanical resonator during the regulation pulses. The locking energy is usually defined as the kinetic energy of the mechanical resonator at the start of the braking pulse less the difference in potential energy of this mechanical resonator between the end and the start of the braking pulse in question, insofar as the mechanical oscillator does not receive maintenance energy during this braking pulse. Therefore, this particular alternative embodiment involves reducing, during the braking pulse, the angular velocity of the balance-hairspring without stopping same for more or less a long time. It should be noted that, in order to ensure the proper operation of the Swiss pallet assembly escapement of a standard timepiece oscillator, it is preferable for the braking pulses not to occur during switching of the pallet assembly, during which switching maintenance energy is supplied from the oscillator. As the switching of the pallet assembly generally occurs about the neutral position of the mechanical resonator, disruption with a braking pulse of the oscillation movement of the balance-hairspring upon the passage thereof via this neutral position will therefore be prevented.

Figure 2:
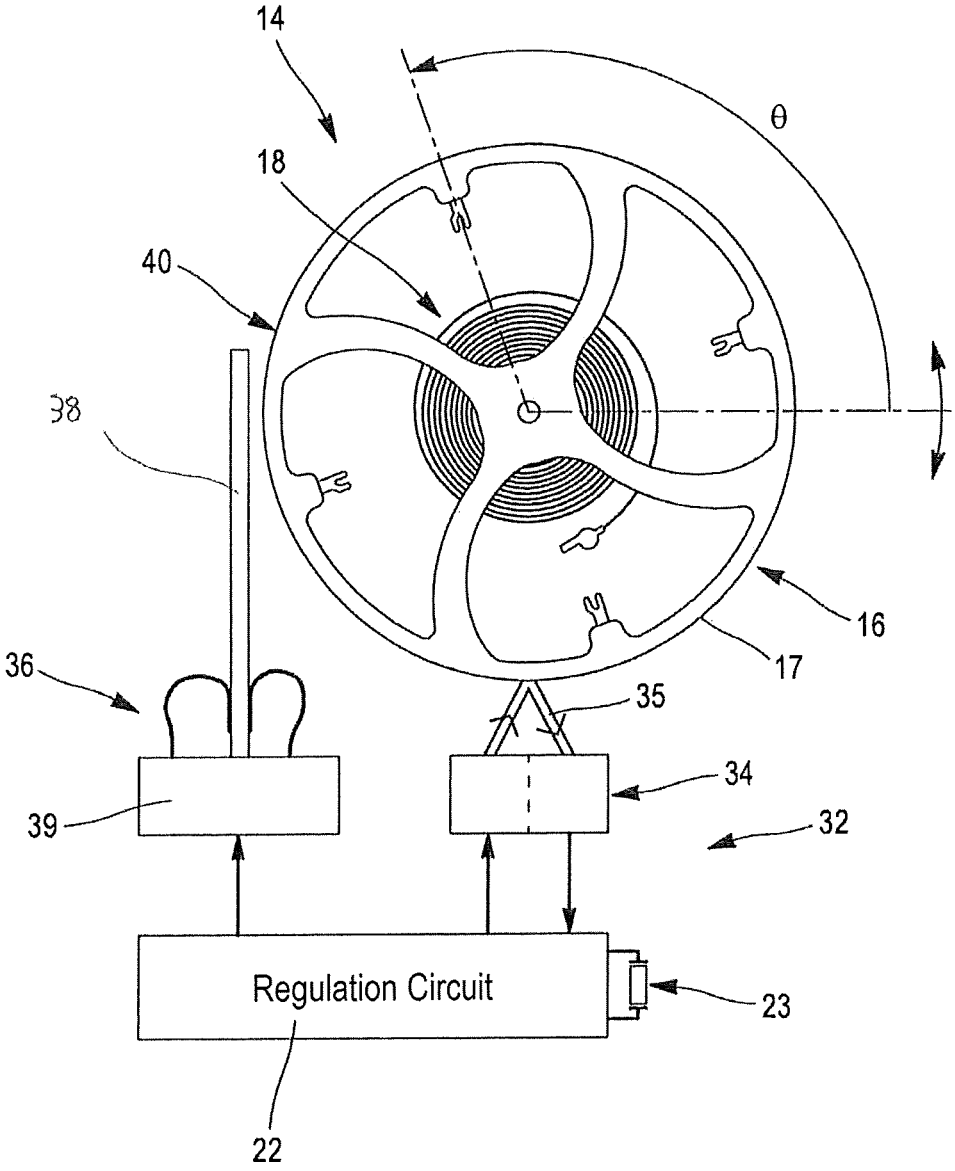
FIG. 2 shows a first embodiment of a regulating device for regulating the oscillation frequency of a balance-hairspring of a timepiece assembly according to the invention.

According to a first embodiment represented in FIG. 2, the regulation pulse application device comprises an actuator 36 having a movable braking member 38, which is actuated in response to a control signal so as to apply to the oscillating member, herein the balance, of the mechanical resonator a certain mechanical force during the mechanical braking pulses. The actuator 36 comprises a piezoelectric element powered by a circuit 39 which generates an electrical voltage according to a control signal supplied by the regulation circuit 22. When the piezoelectric element is powered up momentarily, the braking member comes into contact with a braking surface of the balance in order to brake same. In the example represented in FIG. 2, the strip 38 forming the braking member bends and the end part thereof presses against the circular lateral surface 40 of the felloe 17 of the balance 16. As such, the felloe 17 defines, at least over a certain angular sector, a substantially circular braking surface. Subsequently, the braking member comprises a movable part, herein the end part of the strip, which defines a braking pad arranged so as to apply a pressure against the substantially circular braking surface during the application of the mechanical braking pulses. Preferably, it is envisaged within the scope of the present invention that the oscillating member and the braking member are arranged such that the mechanical braking pulses are applied by dynamic dry friction or viscous friction between the braking member and a braking surface of the oscillating member.

In one advantageous alternative embodiment (not shown), the balance comprises a central shaft which defines, respectively which bears a part other than the felloe of the balance defining, at least over a certain angular sector, a circular braking surface. In this case, a braking member pad is arranged so as to apply a pressure against this circular braking surface during the application of the mechanical braking pulses.

A circular braking surface, for an oscillating member which is pivoted (balance), associated with at least one braking pad, borne by the braking device of the regulating device, forms a mechanical braking system which has decisive advantages. Indeed, by means of such a system, braking pulses may be applied to the mechanical resonator at any time of the oscillations, regardless of the oscillation amplitude of the balance. Subsequently, the correction induced by a braking pulse can be managed precisely, in particular by suitable selection of the duration thereof and by the braking force couple applied. It is also possible, by means of the position measurement made by the sensor, to determine the times during the alternations in order to apply the braking pulses. As such, at least the braking torque, the duration of the pulses and the respective times at which they are induced may be selected and vary according to the time drift of the mechanical oscillator. In particular, it is thereby possible to induce slight corrections for fine and precise regulation of the oscillation frequency.

It should be noted that the oscillation amplitude generally varies according to the degree of arming of the barrel (unless a specific device for producing a constant force is envisaged). As such, at a non-null given time before or after the passage of the resonator via the neutral position thereof in any alternation of the oscillation movement thereof, the angular position of the balance varies according to the oscillation amplitude. If it is chosen for example to give braking pulses to regulate the oscillation frequency always at a defined fixed time interval before or after the passage of the resonator via the neutral position thereof (see the preferred regulation principle disclosed hereinafter), the braking surface should then extend over a certain angular length so that the pad can in any case apply a braking force on the balance at various angular positions along this braking surface. As such, the mechanical resonator has a braking surface which extends over at least a certain angular sector having a certain angular length which is different to zero (i.e. an angular sector is considered to be non-localised), to enable the application of mechanical braking pulses at least at a certain given time in the oscillation periods of the mechanical oscillator, regardless of the oscillation amplitude of the mechanical resonator for usable operating range of the mechanical oscillator.

It should be noted that, according to the time interval mentioned above or according to a time slot chosen to apply braking pulses before or after the passage times of the mechanical resonator via the neutral position thereof in various alternations of the oscillation movement thereof, times which are detected by the sensor 34, it is simply necessary for two defined angular sectors of the balance to have or define respectively two circular surfaces for the braking member pad so that the braking pulses can be applied in a usable operating range of the mechanical oscillator, i.e. over a certain usable angular range for the amplitude of the oscillations thereof (for example between 200° and 300°). In general terms, it is envisaged that the braking surface of the mechanical resonator braking surface of the mechanical resonator comprises at least one first angular sector for the application, in alternations, of first mechanical braking pulses substantially at a first time situated before the median passage time of the mechanical resonator via the neutral position thereof and a second angular sector for the application, in alternations, of second mechanical braking pulses substantially at a second time situated after the median time, regardless of the oscillation amplitude of the mechanical resonator in a usable operating range of the mechanical oscillator in question. It should be noted that, in a specific case where the first time and the second time are envisaged in alternations at the same time distance from the median time and on the same side of the neutral position, the first and second angular sectors are substantially merged and thereby define one and the same angular braking sector. In other cases, the first and second angular sectors have a common part or are separate. The same considerations apply to a first time interval and a second time interval wherein it is possible to envisage respectively applying the first and second braking pulses. In the alternative embodiment represented in FIG. 2, the braking surface has an extent enabling the application of mechanical braking pulses at any time of the oscillations of the mechanical resonator.

It should further be noted that the braking member pad may also have a circular contact surface, of the same radius as the braking surface, but such a configuration is not required. The contact surface may particularly be planar, as shown in the figures. A planar surface has the advantage of allowing a certain margin in the positioning of the braking member relative to the balance, which makes it possible to have greater manufacturing and assembly tolerances of the braking device in the or at the periphery of the timepiece movement.

The sensor 34 is a photoelectric type optical sensor. It comprises a light source, suitable for sending a light beam towards the balance, and a light detector, suitable for receiving a light signal in return, the intensity whereof varies periodically according to the position of the balance. In the schematic example shown in FIG. 2, the beam is sent over the lateral surface of the felloe 17, this surface having a limited zone with a different reflectivity from the two adjacent zones, such that the sensor can detect the passage of this limited zone and supply the regulating device with a position signal when this event occurs. It shall be understood that the circular surface having a variable reflection for the light beam may be situated at other locations of the balance. The variation may in one particular case be produced by a hole in the reflective surface. The sensor may also detect the passage of a certain part of the balance, for example an arm, the neutral position corresponding for example to the midpoint of a signal reflected by this arm or to the start, or to the end, of such a signal. It is therefore understood that the modulation of the light signal, which may consist of a succession of light pulses received in return by the photodetector, may define the angular position of the balance in various manners, by a negative or positive variation of the light detected.

In other alternative embodiments, the position sensor may be of the capacitive type or of the inductive type and as such be suitable for detecting a variation in capacitance, or of inductance according to the position of the balance. The inductive sensor preferably functions without the presence of magnetised material on the resonator, for example by detecting the presence of non-magnetised material or merely a variation in distance between such a material and the sensor. Those skilled in the art know numerous sensors which could be readily incorporated in the timepiece assembly according to the invention.

Advantageously, the various elements of the regulating device 6 form an independent module of the timepiece movement. As such, this module may be assembled or associated with the mechanical movement 4 only during the assembly thereof particularly in a watch case. In particular, such a module may be attached to a casing ring surrounding the timepiece movement. It is understood that the electronic regulation module may therefore be advantageously associated with the timepiece movement once the latter is entirely assembled and adjusted, the assembly and disassembly of this module being possible without having to work on the mechanical movement per se.

A regulation method will be described hereinafter, with reference to FIGS. 3 and 4, which represents a remarkable enhancement of the invention, followed by embodiments of timepiece assemblies according to the invention wherein this very advantageous regulation method is implemented.

Figure 3:
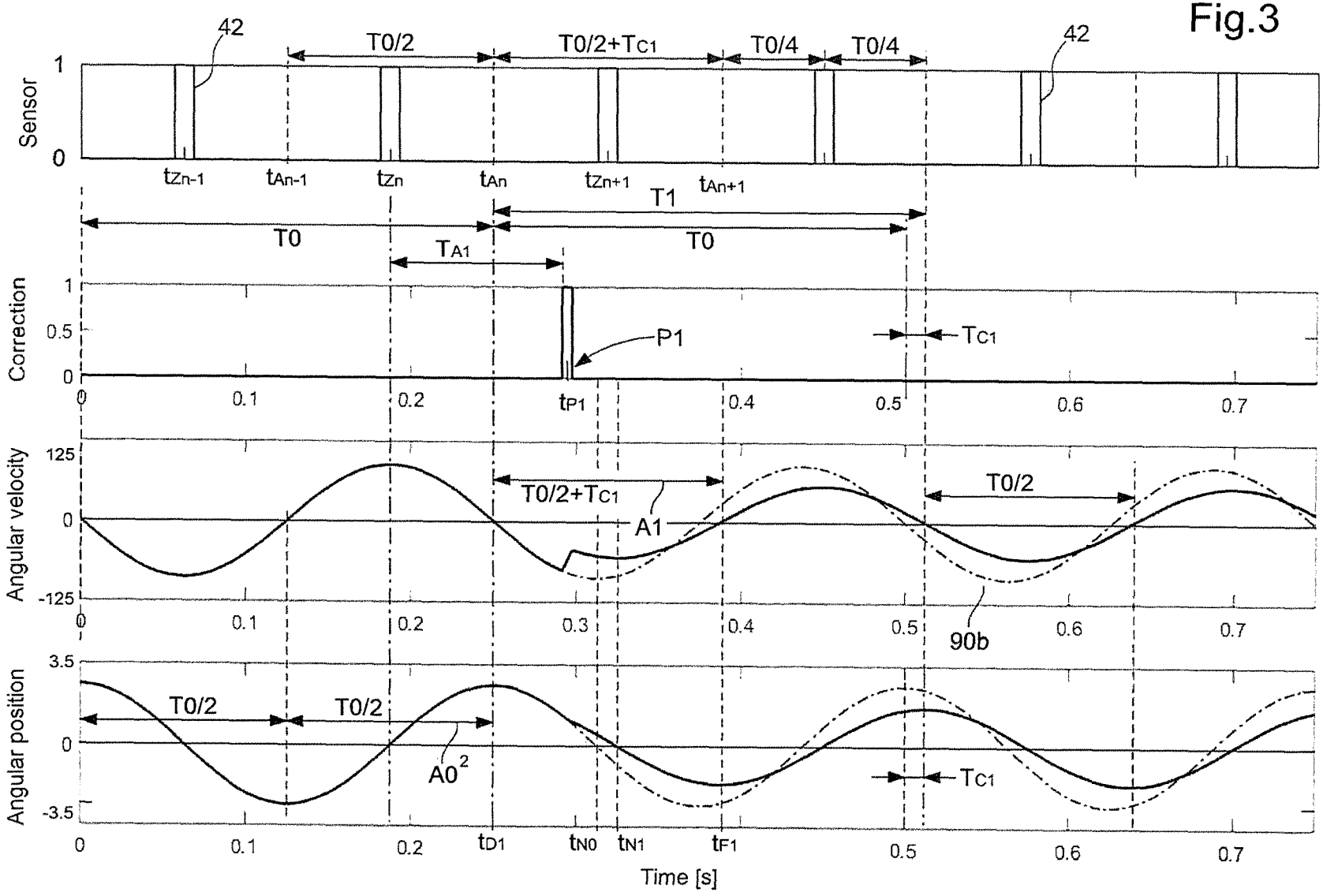
FIG. 3 shows the position signal supplied by a sensor detecting the passage of the balance-hairspring via the neutral position thereof and the application of a first braking pulse in a certain alternation before the balance-hairspring passes via the neutral position thereof, as well as the angular velocity and the angular position thereof in a time interval during which the first braking pulse occurs.

FIG. 3 shows four graphs. The first graph gives the digital signal supplied over time by the sensor 34 when the resonator 14 oscillates, i.e. when the mechanical oscillator of the timepiece assembly is activated. It should be noted that the digital signal may be supplied in a first alternative embodiment directly by the sensor, but in a second alternative embodiment the sensor supplies an analogue signal and the regulation circuit converts same into a digital signal, particularly by means of a comparator. As described above, the sensor and the balance are suitable for enabling the sensor to detect the successive passages of the balance-hairspring via the neutral position thereof. Such an event occurs twice per oscillation period, once in each of the two alternations at a time $t_{Zn}$ at which the sensor supplies a pulse 42.

Figure 4:
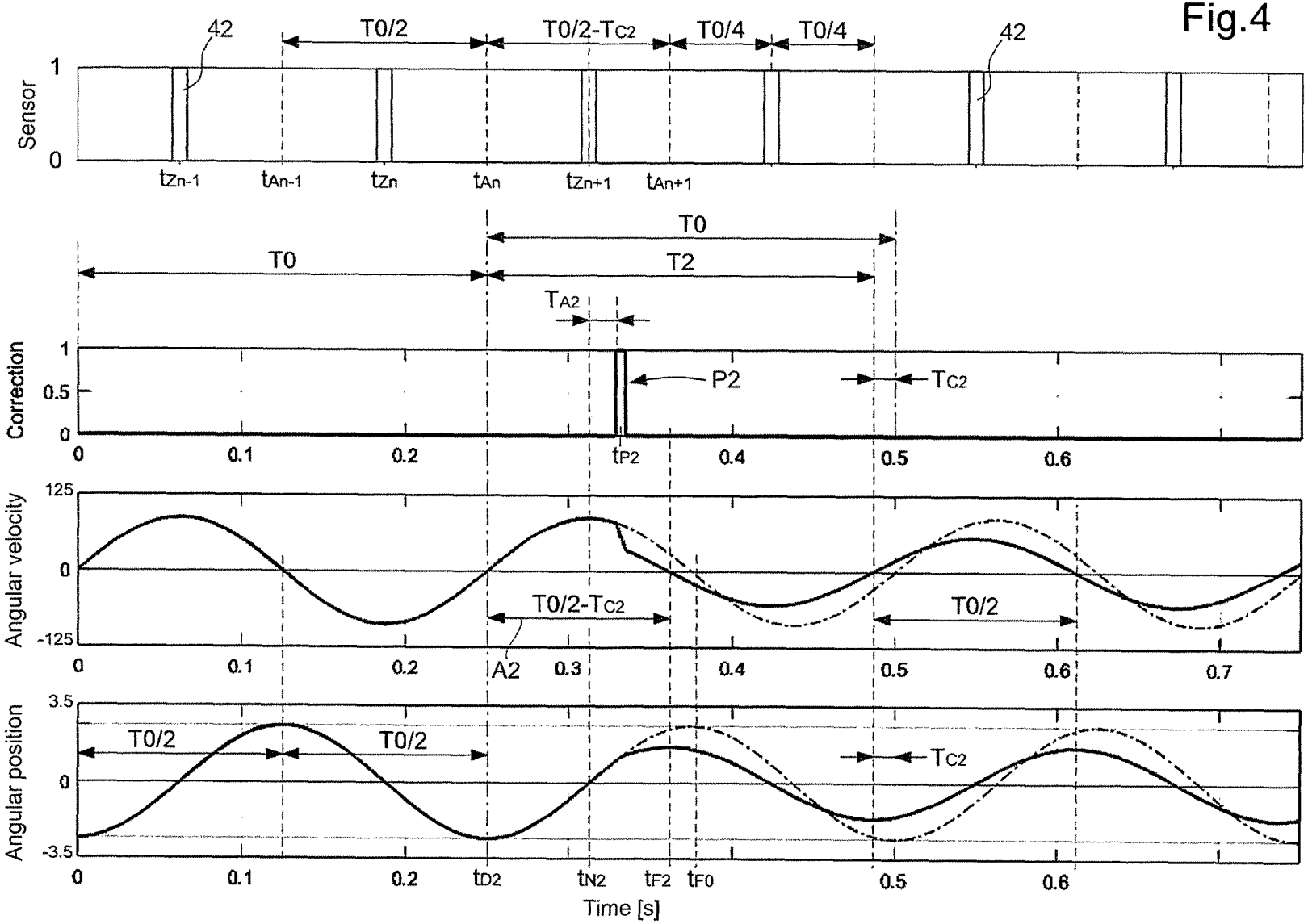
FIG. 4 is a similar figure to that in FIG. 3 with the application of a second braking pulse in a certain alternation after the balance-hairspring has passed via the neutral position thereof.

Each oscillation period of the mechanical oscillator defines a first alternation followed by a second alternation between two end positions defining the oscillation amplitude of this mechanical oscillator, each alternation having a passage of the mechanical resonator via the neutral position thereof at a median time $t_{Zn}$ and a duration between an initial time $t_{An-1}$, respectively $t_{D1}$ for the alternation A1 in FIG. 3 and $t_{D2}$ for the alternation A2 in FIG. 4, and an end time $t_{An}$, respectively $t_{F1}$ for the alternation A1 in FIG. 3 and $t_{F2}$ for the alternation A2 in FIG. 4. These initial and end times are defined respectively by the two end positions occupied by the mechanical resonator respectively at the start and at the end of each alternation. The second graph shows the time $t_{P1}$ at which a braking pulse is applied to the mechanical resonator 14 to make a correction in the operation of the mechanism timed by the mechanical oscillator. The times at which rectangular-shaped pulses (i.e. a binary signal) occur are defined in FIGS. 3 and 4 by the time positions of the midpoint of these pulses. However, according to the alternative embodiment and the embodiment of the regulation circuit, the start or end of a pulse may be considered as the time characterising same, i.e. either the rising edge or the falling edge of said pulse. This is particularly the case for braking pulses wherein the start (i.e. the triggering) and the duration are generally determined.

A variation in the oscillation period during which the braking pulse occurs and therefore an isolated variation of the frequency of the mechanical oscillator are observed. In fact, as seen in the last two graphs in FIG. 3, respectively showing the angular velocity (values in radian per second: [rad/s]) and the angular position (values in radian: [rad]) of the balance over time, the time variation relates to the sole alternation during which the braking pulse occurs. It should be noted that each oscillation has two successive alternations which are defined in the present text as the two half-periods during which the balance respectively sustains an oscillation movement in one direction and subsequently an oscillation movement in the other direction. In other words, an alternation corresponds to an oscillation of the balance in one direction or the other between the two end positions thereof defining the oscillation amplitude.

The term braking pulse denotes an application, substantially during a limited time interval, of a certain force couple to the mechanical resonator braking same, i.e. a force couple opposing the oscillation movement of this mechanical resonator. Within the scope of the invention, each braking pulse is generated by mechanical braking applying a mechanical braking couple to the mechanical resonator, as shown by the third graph representing the angular velocity of the balance.

In FIGS. 3 and 4, the oscillation period T0 corresponds to a 'free' oscillation (i.e. without applying regulation pulses) of the mechanical oscillator of the timepiece assembly. The two alternations of an oscillation period each have a duration T0/2 without external disturbance or constraint (particularly by a regulation pulse). The time t=0 marks the start of a first alternation. It should be noted that the 'free' frequency F0 of the mechanical oscillator is herein approximately equal to four Hertz (F0=4 Hz), such that the period T0=250 ms approximately.

The behaviour of the mechanical oscillator in a first correction scenario of the oscillation frequency thereof, corresponding to that shown in FIG. 3, will firstly be described. After a first period T0 commences a new period T1, respectively a new alternation A1 during which a braking pulse P1 occurs. At the initial time $t_{D1}$ starts the alternation A1, the resonator 14 occupying a maximum positive angular position corresponding to an end position. Then the braking pulse P1 occurs at the time $t_{P1}$ which is situated before the median time $t_{N1}$ at which the resonator passes via the neutral position thereof. Finally, the alternation A1 ends at the end time $t_{F1}$. The braking pulse is triggered after a time interval $T_{A1}$ following the last median time $t_{Zn}$ detected by the sensor before the alternation A1. The duration $T_{A1}$ is selected greater than a half-alternation T0/4 and less than an alternation T0/2 less the duration of the braking pulse P1. In the example given, the duration of this braking pulse is considerably less than a half-alternation T0/4. The term 'median time' denotes a time occurring substantially at the midpoint of the alternations. This is specifically the case when the mechanical oscillator oscillates freely. On the other hand, for the alternations during which regulation pulses are supplied, it should be noted that this median time no longer corresponds exactly to the midpoint of the duration of each of these alternations due to the disturbance of the mechanical oscillator induced by the regulation device.

In this first case, the braking pulse is generated between the start of an alternation and the passage of the resonator via the neutral position thereof in this alternation. As envisaged, the angular velocity in absolute values decreases during the braking pulse P1. Such a braking pulse induces a negative time phase shift $T_{C1}$ in the oscillation of the resonator, as shown by the two graphs of the angular velocity and of the angular position in FIG. 3, i.e. a delay relative to the non-disturbed theoretical signal (shown with broken lines). As such, the duration of the alternation A1 is increased by a time interval $T_{C1}$. The oscillation period T1, comprising the alternation A1, is therefore extended relative to the value T0. This induces an isolated decrease in the frequency of the mechanical oscillator and a momentary slowing-down of the operation of the associated mechanism.

With reference to FIG. 4, the behaviour of the mechanical oscillator in a second correction scenario of the oscillation frequency thereof will now be described. The graphs in this FIG. 4 show the progression over time of the same variables as in FIG. 3. After a first period T0 commences a new oscillation period T2, respectively an alternation A2 during which a braking pulse P2 occurs. At the initial time $t_{D2}$ starts the alternation A2, the mechanical resonator then being in an end position (maximum negative angular position). After a quarter-period (T0/4) corresponding to a half-alternation, the resonator reaches the neutral position thereof at the medium time $t_{N2}$. Then the braking pulse P2 occurs at the time $t_{P2}$ which is situated after the median time $t_{N2}$ at which the resonator passes via the neutral position thereof in the alternation A2. Finally, after the braking pulse P2, this alternation A2 ends at the end time $t_{F2}$ at which the resonator once again occupies an end position (maximum positive angular position in the period T2). The braking pulse is triggered after a time interval $T_{A2}$ following the median time $t_{N2}$ of the alternation A2. The duration $T_{A2}$ is selected less than a half-alternation T0/4 less the duration of the braking pulse P2. In the example given, the duration of this braking pulse is considerably less than a half-alternation.

In the second case in question, the braking pulse is therefore generated, in an alternation, between the median time at which the resonator passes via the neutral position thereof and the end time at which this alternation ends and at which the resonator occupies an end position. As envisaged, the angular velocity in absolute values decreases during the braking pulse P2. Remarkably, the braking pulse induces herein a positive time phase shift $T_{C2}$ in the oscillation of the resonator, as shown by the two graphs of the angular velocity and the angular position in FIG. 4, i.e. an advance relative to the non-disturbed theoretical signal (shown with broken lines). As such, the duration of the alternation A2 is decreased by the time interval $T_{C2}$. The oscillation period T2 comprising the alternation A2 is therefore shorter than the value T0. Consequently, this induces an isolated increase in the frequency of the mechanical oscillator and a momentary acceleration of operation of the associated mechanism. This phenomenon is surprising and not obvious, which is the reason why those skilled in the art have ignored it in the past.

This regulation method is remarkable in that it makes use of a surprising physical phenomenon of the mechanical oscillator. The inventors arrived at the following observation: Unlike the general teaching in the field of timepieces, it is possible not only to reduce the frequency of a mechanical oscillator with braking pulses, but it is also possible to increase the frequency of such a mechanical oscillator also with braking pulses. Those skilled in the art would expect to be able to practically only reduce the frequency of a mechanical oscillator with braking pulses and, by way of corollary, to be able to only increase the frequency of such a mechanical oscillator by applying drive pulses when supplying power to said oscillator. Such an intuitive idea, which has become established in the field of timepieces and therefore comes first to the mind of those skilled in the art, proves to be incorrect for a mechanical oscillator. Although such behaviour is correct for a micro-generator, wherein the rotor rotates continuously in the same direction, this is on the contrary not true for a mechanical oscillator in that it oscillates.

Indeed, it is possible to regulate electronically, via an auxiliary oscillator comprising for example a quartz resonator, a mechanical oscillator that is moreover high-precision, so that it momentarily exhibits a frequency that is slightly too high or too low. To do this, it is envisaged to select correctly, according to the operating of the mechanism in question and therefore the frequency of the mechanical oscillator setting the pace of this operation, the time to apply a mechanical braking pulse. The inventors observed that the effect produced by a regulation pulse on a mechanical resonator is dependent on the time when it is applied in an alternation relative to the time when this mechanical resonator passes via the neutral position thereof. According to this principle revealed by the inventors and used in a timepiece assembly according to the invention, a braking pulse applied, in any alternation between the two end positions of the mechanical resonator, substantially prior to the passage of the mechanical resonator via the neutral position thereof (idle position) produces a negative time phase shift in the oscillation of said resonator and therefore a delay in the operation of the mechanism paced by the resonator, whereas a braking pulse applied in this alternation substantially after the passage of the mechanical resonator via the neutral position thereof produces a positive time phase shift in the oscillation of said resonator and thereof an advance in the operation of the mechanism. It is thereby possible to correct a frequency that is too high or a frequency that is too low merely by means of braking pulses. In sum, applying a braking couple during an alternation of the oscillation of a balance-hairspring induces a negative or positive phase shift in the oscillation of said balance-hairspring according to whether said braking torque is applied respectively before or after the passage of the balance-hairspring via the neutral position thereof.

Making use of the physical phenomena described above, a main embodiment of the timepiece assembly according to the invention is characterised by a particular arrangement of the regulating device of the mechanical oscillator and particularly the electronic regulation circuit. Generally, this regulation device comprises a measuring device suitable for measuring, if applicable, a time drift of the mechanical oscillator relative to an auxiliary oscillator, which is implicitly more precise than the mechanical resonator, and for determining whether this time drift corresponds to at least a certain advance or to at least a certain delay. Then, the regulating device comprises a control circuit connected to the regulation pulse application device described above, which are suitable for applying to the mechanical resonator, when the time drift of the mechanical oscillator corresponds to at least a certain advance, a first braking pulse substantially in a first half-alternation prior to the median passage time of the mechanical resonator via the neutral position thereof and, when the time drift of the mechanical oscillator corresponds to at least a certain delay, a second braking pulse substantially in a second half-alternation after the median passage time of the mechanical resonator via the neutral position thereof.

In one preferred embodiment that will be described in more detail hereinafter, the regulating device comprises a device for determining time positions of the mechanical resonator, this determining device being suitable for determining, in an alternation of an oscillation, a first time occurring prior to the median passage time of the mechanical resonator via the neutral position thereof and after the initial time at which this alternation starts, as well as, in the same alternation or another alternation of an oscillation, a second time occurring after the median passage time of the mechanical resonator via the neutral position thereof and before the end time at which this alternation ends. Subsequently, the control circuit is suitable for selectively detecting a first braking pulse substantially at the first time and a second braking pulse substantially at the second time.

It should be noted that the device for determining time positions of the mechanical resonator may have elements or members in common with the measuring device, in particular the position measurement sensor, and with the control circuit, for example a logic circuit and operationally a counter. However, such embodiments are in no way limiting within the scope of the present invention.

Figure 5:
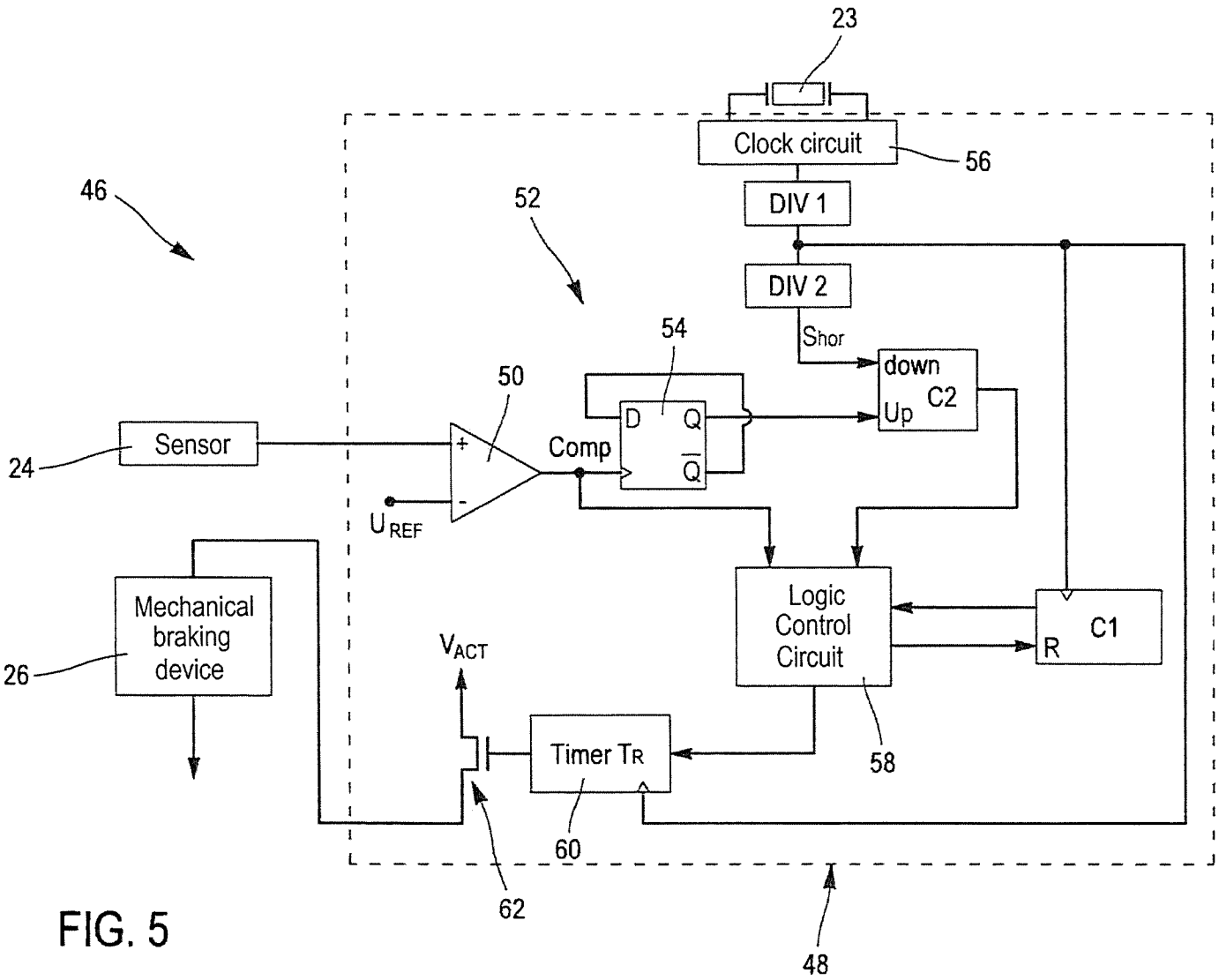
FIG. 5 shows the electronic diagram of a second embodiment of the device for regulating the mechanical oscillator according to the invention.
Figure 6:
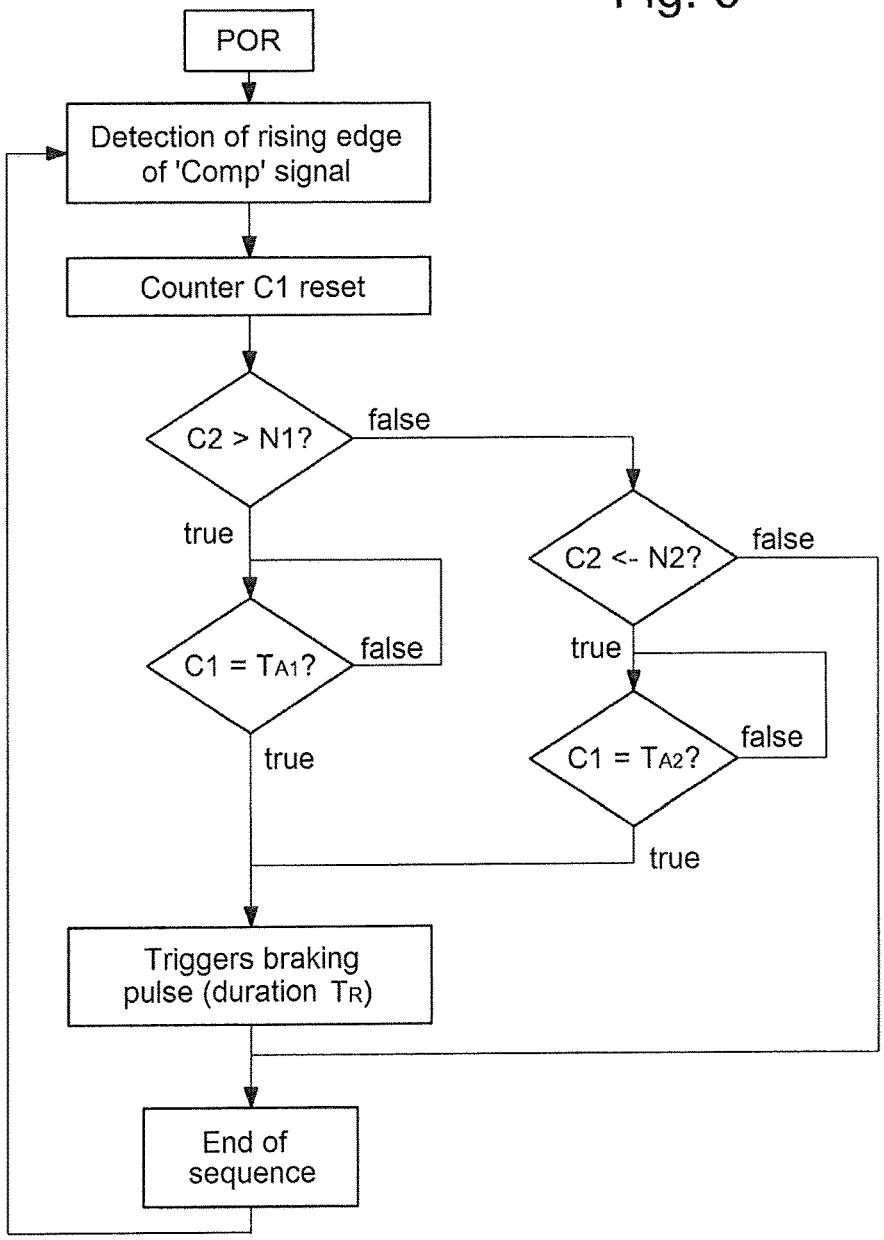
FIG. 6 is a flow chart of an operating mode of the regulating device in FIG. 5.

With reference to FIGS. 5 and 6, a second embodiment of a timepiece assembly according to the invention, in particular of the regulating device thereof, will be described hereinafter. The regulating device 46 comprises an electronic regulation circuit 48 and an auxiliary resonator 23. This auxiliary resonator is for example an electronic quartz resonator. The sensor 24 supplies herein an analogue signal consisting of pulses occurring at the successive passages of the balance-hairspring via the neutral position thereof. This analogue signal is compared to a reference voltage $U_{REF}$ by means of a hysteresis comparator 50 (Schmidt trigger) arranged in the circuit 48 so as to generate a digital signal 'Comp' for the digital electronics of the regulation circuit. This digital signal 'Comp' consists of a succession of digital pulses 42 wherein the respective rising edges occur respectively at the times $t_{Zn}$, n=1, 2, . . . , N, . . . (see FIGS. 3 and 4).

The comparator is an element of a measurement circuit 52 described hereinafter. Given that there are two pulses 42 per oscillation period of the mechanical resonator, the digital signal 'Comp' is supplied to a lever 54, which regularly supplies one pulse per oscillation period. The lever increments, at the instantaneous frequency of the mechanical oscillator, a bidirectional counter C2, which is decremented at a nominal frequency/set-point frequency by a clock signal $S_{hor}$ derived from the auxiliary oscillator which generates a digital signal at a reference frequency. This auxiliary oscillator is formed from the auxiliary resonator 23 and a clock circuit 56. For this purpose, the relatively high-frequency reference signal generated by the clock circuit is previously split by the splitters DIV1 and DIV2 (these two splitters optionally forming two stages of the same splitter). As such, the state of the counter C2 determines the advance or delay accumulated over time by the mechanical oscillator relative to the auxiliary oscillator with a resolution corresponding substantially to the set-point period, the state of the counter being supplied to a logic control circuit 58. The state of the counter C2 corresponds to the time drift of the mechanical oscillator.

As indicated in the flow chart in FIG. 6, upon the activation of the regulating device and the power-up of the regulation circuit 48 thereof, this circuit is initialised at the step POR. In particular, a 'reset' of the counter C2 is performed. Then, the detection of a first rising edge of the digital signal 'Comp' is awaited. At that time, the control circuit 58 resets the counter C1. Simultaneously, the control circuit verifies whether a certain time drift has been observed. More particularly, it determines whether the possible time drift corresponds to a certain advance (C2>N1?) or to a certain delay (C2<-N2?). It should be noted that N1 and N2 are natural numbers (positive whole numbers different to zero). In the case where such an advance, respectively such a delay, are not observed, the control circuit ends the sequence (implemented in a loop) and awaits the occurrence of another pulse 42 in the sensor signal.

If the condition C2>N1 is verified ('true'), then the control circuit waits until the counter C1 has measured a first time interval $T_{A1}$ (see FIG. 3) and then sends a control signal to a timer 60 which immediately closes a switch 62 (which then switches to the 'ON' state) in order to power up the mechanical braking device, more specifically so that the latter activates the mechanical braking member thereof during a braking period $T_R$. In the case of a piezoelectric element used for moving the movable end part of the strip 38 towards the felloe or the shaft of the balance (see FIG. 2), the switch 62 then orders the power-up of this piezoelectric element. The first interval $T_{A1}$ is selected greater than a half-alternation T0/4 and less than an alternation T0/2 less at least the duration of the braking pulse, such that the entire braking pulse is applied in an alternation prior to the passage of the mechanical resonator via the neutral position thereof, to induce a decrease in the instantaneous frequency of the mechanical oscillator, given that the time drift indicates that the free frequency thereof is greater on average than the nominal frequency, i.e. greater than the set-point frequency determined by the auxiliary oscillator. Following the generation of a braking pulse (duration $T_R$), the sequence is ended and a new sequence is started pending the occurrence of another pulse 42 in the signal supplied by the sensor.

If the condition C2<-N2 is verified ('true'), then the control circuit waits until the counter C1 has measured a second time interval $T_{A2}$ (see FIG. 4) and then sends a control signal to a timer 60 which immediately closes the switch 62 so that the mechanical braking device activates the mechanical braking member thereof during a braking period $T_R$. Following the generation of a braking pulse (duration $T_R$), the sequence is ended and a new sequence is started pending the occurrence of another pulse 42 in the signal supplied by the sensor. The second interval $T_{A2}$ is selected less than a half-alternation T0/4 less the duration of the braking pulse, such that the entire braking pulse is applied in an alternation after the passage of the mechanical resonator via the neutral position thereof and prior to the end of the alternation in question to induce an increase in the instantaneous frequency of the mechanical oscillator, given that the time drift indicates that the free frequency thereof is less on average than the set-point frequency.

It should be noted that, in FIGS. 3 and 4, the time intervals $T_{A1}$ and $T_{A2}$ start exactly at the passages of the mechanical resonator via the neutral position thereof. However, if the pulses 42 are centred on such an event and exhibit a certain duration different to zero, the detection of the rising edge thereof or of the falling edge thereof then displays a certain time shift with respect to this event. As such, it is understood that the value ranges for the intervals $T_{A1}$ and $T_{A2}$ may be herein slightly different to those resulting from FIGS. 3 and 4 (slight variations of the limit values, substantially of half the duration of the position pulses) in order to comply with the two main conditions of the regulation method.

It should be noted that, in the case where C2>N1 or C2<-N2, it can be envisaged, in one alternative embodiment, to supply a plurality of successive control pulses at a plurality of times $t_{Zn}+T_{A1}$, respectively $t_{Zn}+T_{A2}$ according to the method described. This involves inhibiting the query of the state of the counter C2 during a certain number of sequences. Such an alternative embodiment makes it possible to supply a succession of low-energy braking pulses. In order to limit the possible range for the time drift of the oscillator, low values will preferably be taken for N1 and N2. For example N1=N2=1 or 2.

The sensor, the comparator 50, the control circuit 58 and the counter C1, incremented by the clock circuit 60 via the splitter DIV1, form together a device for determining time positions of the mechanical resonator which makes it possible to apply mechanical braking pulses in various alternations selectively before and after the passage of the mechanical resonator via the neutral position thereof. As such, the preferred regulation method described above may be implemented effectively and safely, so as to correct a natural frequency of the mechanical oscillator which is too high or too low relative to the set-point frequency generated by the clock circuit 60 via the splitters. The device for determining time positions is therefore suitable for measuring, following the detection of a passage of the resonator via the neutral position thereof, a first time interval and a second time interval wherein the respective ends define respectively a first time and a second time which are situated temporally, in any alternation of the oscillation of the mechanical resonator, respectively before and after the time of the passage of said resonator via the neutral position thereof.

Figure 8:
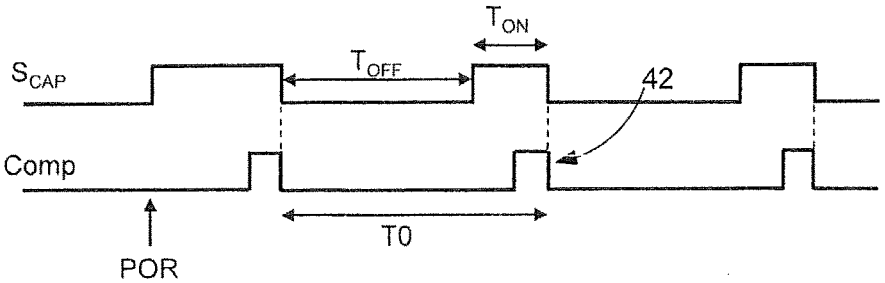
FIG. 8 shows two digital signals occurring in the electronic circuit in FIG. 7.
Figure 7:
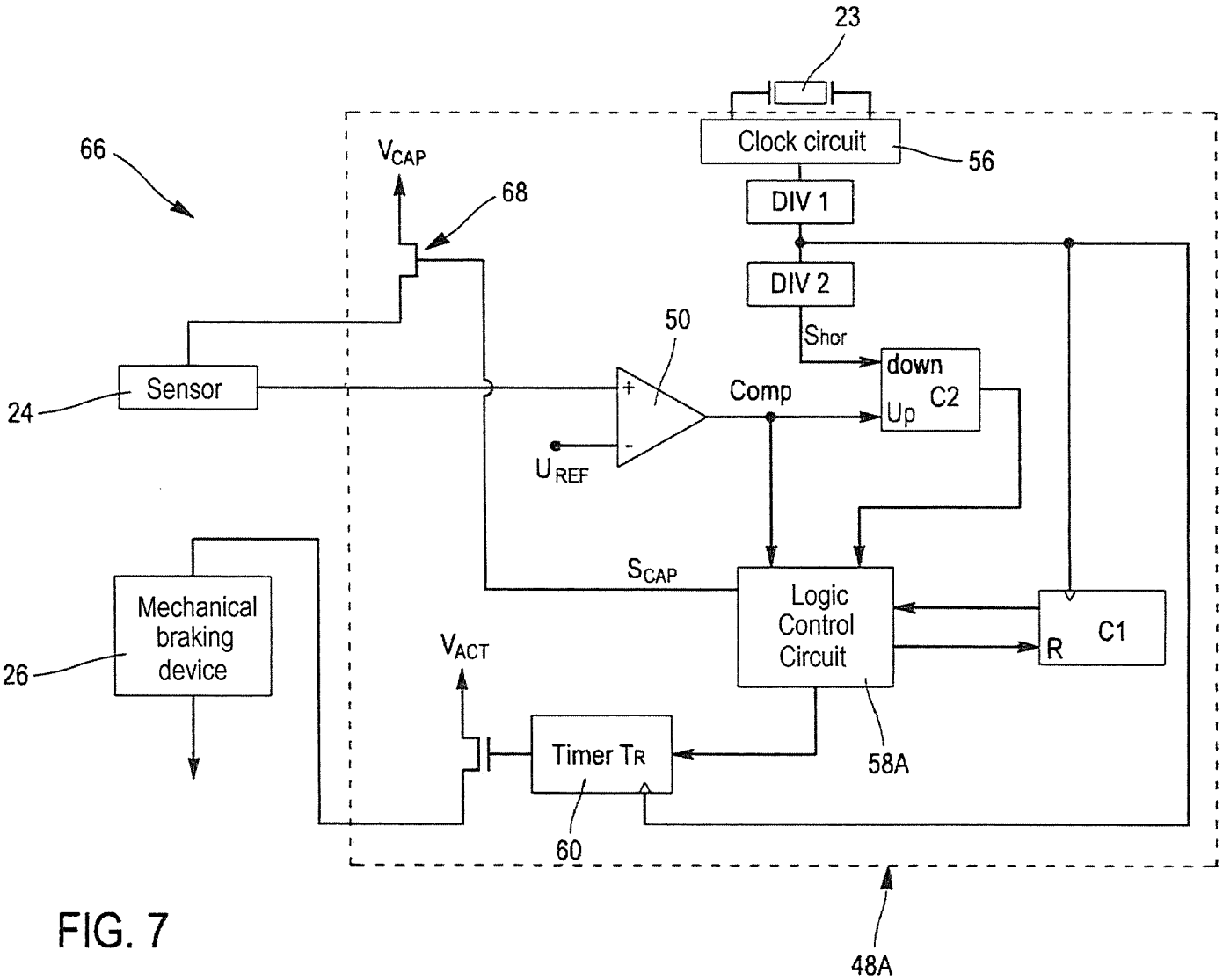
FIG. 7 shows the electronic diagram of an alternative embodiment of the second embodiment of the regulating device of the mechanical oscillator.
Figure 9:
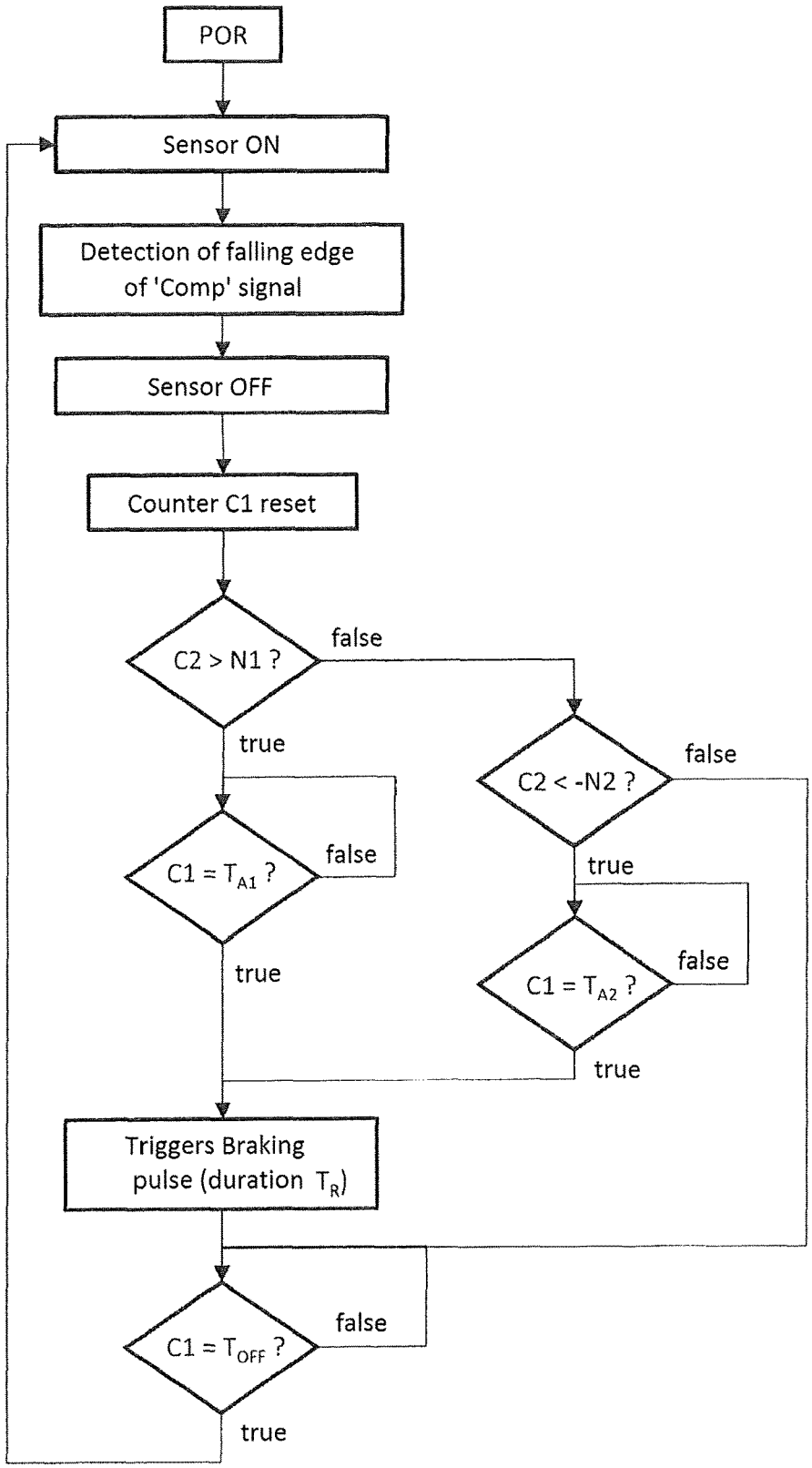
FIG. 9 is a flow chart of an operating mode of the regulating device in FIG. 7.

With reference to FIGS. 7 to 9, an alternative embodiment of the second embodiment of the invention will be described, which defines an enhancement of the regulating device according to the invention in relation with management of the electricity consumed by the sensor. The elements of the regulation circuit 48A, which are identical to those of the alternative embodiment described with reference to FIGS. 5 and 6, will not be described again herein, similarly for the regulation method which corresponds to that of this alternative embodiment described above. The regulating device 66 is distinguished from the regulating device 46 in that the sensor 24 has a standby mode or that it can even be switched off. As such, the term 'OFF' state denotes that the sensor is rendered inactive and that it is then found in a state of lower electrical consumption than in the 'ON' state thereof wherein it detects swings of the mechanical resonator.

It is envisaged, in the present alternative embodiment, to set the sensor to the 'OFF' state during the main part of each oscillation of the mechanical oscillator. For this purpose, the control circuit 58A is suitable for supplying a control signal $S_{CAP}$ to a switch 68 which controls the power supply of the sensor 24, respectively which controls the state of said sensor between the 'ON' state thereof and the 'OFF' state thereof. As indicated by the signals $S_{CAP}$ and Comp in FIG. 8, it is envisaged to set the sensor to the 'OFF' state thereof during a time interval $T_{OFF}$ T0 and to the 'ON' state thereof during a time interval $T_{ON}$ in each oscillation period T0 (note that T0=$T_{OFF}+T_{ON}$). Preferably, the duration of $T_{ON}$ is envisaged less than a half-alternation T0/4 to minimise the power consumption of the sensor. Indeed, it is possible that the digital signal 'Comp' exhibits pulses of relatively short duration, such that the detection of a pulse 42 per oscillation period only requires a relatively small time window $T_{ON}$. In this case, the comparator 50 only delivers a single pulse 42 per oscillation period, such that the lever envisaged in the preceding alternative embodiment is removed. The comparator 50 directly supplies the output signal thereof to the counter C2.

In the flow chart in FIG. 9, the management of the power supply of the sensor appears by setting the sensor to the 'OFF' state thereof in each sequence of the regulation method according to the detection of the falling edge of a pulse 42 of the 'Comp' signal. It should be noted that in this alternative embodiment, the falling edge of the pulses 42 of the position signal is detected. The sensor can thereby detect an entire position pulse 42 in the interval $T_{ON}$. However, for the regulation per se, the detection of the rising edge or the falling edge does not change anything. For the detection of the position of the balance, the detection of the rising edge of the pulses is also possible for triggering the switch of the sensor from the 'ON' state thereof to the 'OFF' state thereof. In the latter case, the duration of the pulses 42 is reduced significantly since the sensor is rendered inactive directly after the start of these pulses. Such an alternative embodiment of implementation makes it possible to reduce the consumption of the sensor further.

During the activation of the regulating device, the sensor is set directly to the 'ON' state thereof pending the detection of the falling edge of a first pulse 42 (corresponding to a passage via the neutral position of the mechanical resonator). Once this detection has taken place, the sensor is set to the 'OFF' state thereof (sensor OFF) and the regulation sequence continues as in the preceding alternative embodiment. On the other hand, whether a braking pulse is generated or not, the control circuit 58A continues to follow the incrementation of the counter C1 until the value thereof corresponds to the time interval $T_{OFF}$ envisaged. Then the sequence ends with a further activation of the sensor (Sensor ON) which also marks the start of a subsequent sequence. The algorithm as given in FIG. 9 envisages that the duration $T_{OFF}$ is greater than the duration $T_{A1}$. This condition indicates that the interval $T_{OFF}$ is substantially greater than an alternation T0/2. In a further alternative embodiment, it is envisaged to only detect the passage via the neutral position once in a time interval nT0 corresponding to a plurality of oscillation periods (n>1). In such an alternative embodiment, the measuring device is modified accordingly so that the counter C2 only receives a single set-point pulse, derived from the auxiliary oscillator, in the successive intervals nT0.

Figure 10:
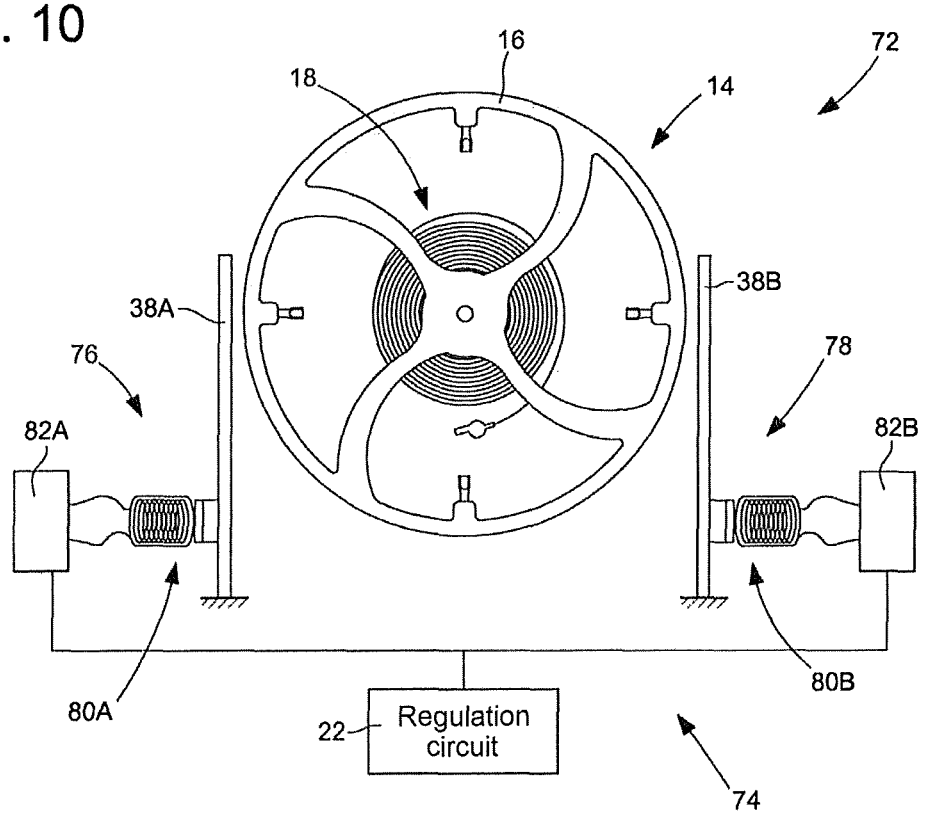
FIG. 10 shows a third embodiment of a regulating device according to the invention.

With reference to FIG. 10, a third embodiment of a timepiece assembly 72 will be described hereinafter, which is distinguished from the preceding embodiments by the arrangement of the braking device 74 thereof. The actuator of this braking device comprises two braking modules 76 and 78 each formed by a strip 38A, respectively 38B actuated by a magnet-coil magnetic system 80A, respectively 80B. The coils of the two magnetic systems are respectively controlled by two power supply circuits 82A and 82B which are electrically connected to the regulation circuit 22. The strips 38A and 38B define a first brake pad and a second brake pad. These two brake pads are arranged such that, during the application of the mechanical braking pulses, they apply to the balance respectively two diametrically opposed radial forces relative to the axis of rotation of the balance 16 and in opposite directions. Obviously, the force couple applied by each of the two pads during a braking pulse is envisaged substantially equal to the other. As such, the resultant of the forces in the general plane of the balance is substantially zero such that no radial force is applied to the balance shaft during the braking pulses. This prevents mechanical stress for the pivots of this balance shaft and more generally at the bearings associated with these pivots. Such an arrangement may advantageously be incorporated in an alternative embodiment where braking is performed on the balance shaft or on a disk of relatively small diameter borne by this shaft.

In one alternative embodiment, the braking force applied to the balance may be envisaged to be axial. In such an alternative embodiment, it is advantageous to envisage a braking device of the type proposed in FIG. 10. In this case, the actuator is arranged such that, upon the application of the braking pulses, the first pad and the second pad apply to the balance two substantially axial axial forces of opposite directions. The force couple applied by each of the two pads by a braking pulse is also envisaged herein to be substantially equal to the other.

Figure 11:
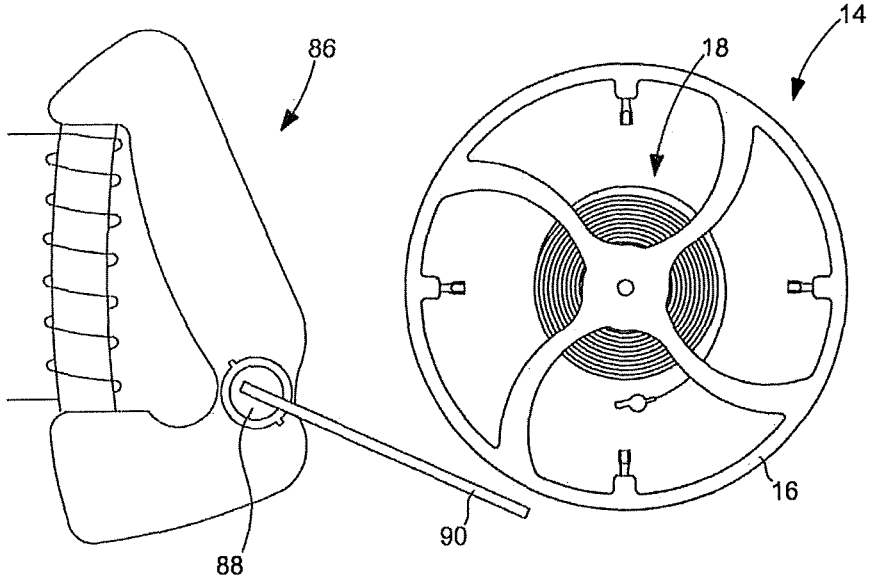
FIG. 11 shows a particular embodiment of the braking device of a regulating device according to the invention.

An actuator forming a particular braking device is shown in FIG. 11. The actuator comprises a timepiece type motor 86 and a braking member 90 which is mounted on a rotor 88, having a permanent magnet, of this motor so as to apply a certain pressure on the balance 16 of the resonator 14 when the rotor performs a certain rotation, which is induced by a power supply of a motor coil during the braking pulses in response to a control signal supplied by the regulation circuit.

What is claimed is:

1. A timepiece assembly, comprising:

a mechanism;

a mechanical resonator that oscillates along an oscillation axis about a neutral position corresponding to a minimum potential mechanical energy state of the mechanical resonator;

a maintenance device that maintains the mechanical resonator, the maintenance device and the mechanical resonator together forming a mechanical oscillator that defines a working rate of the mechanism, each oscillation of the mechanical resonator exhibits two successive alternations between two end positions on the oscillation axis which define the oscillation amplitude of the mechanical oscillator;

a regulating device that regulates a frequency of oscillation of the mechanical oscillator, the regulating device comprising an auxiliary oscillator, a regulation pulse application device that applies regulation pulses to the mechanical resonator, and an electronic control circuit that generates a control signal which is supplied to and activates the regulation pulse application device; and a sensor that detects a position of the mechanical resonator on the oscillation axis;

wherein the regulating device comprises a measuring device that measures, on the basis of position signals supplied by said sensor, a time drift of the mechanical oscillator relative to the auxiliary oscillator, wherein the regulation pulse application device is formed by an electromechanical device that generates, in response to the control signal which is dependent on the time drift measured, mechanical braking pulses applied to a braking surface of the mechanical resonator, wherein at least one mechanical braking pulse applies a brake force on the braking surface when a time drift of the mechanical oscillator is detected, and wherein the braking surface includes a portion that extends along said oscillation axis and enables the application of the mechanical braking pulse during an alternation of the mechanical oscillator in an amplitude range corresponding to a usable operating range of the mechanical oscillator, and wherein said application of the mechanical braking pulse is applied at a selected time such that said mechanical braking pulse does not occur while the mechanical resonator passes the neutral position.

2. The timepiece assembly according to claim 1, wherein the regulation pulse application device includes an actuator comprising a braking member that actuates, in response to the control signal, to apply a mechanical force to an oscillating member of the mechanical resonator during the mechanical braking pulses, and wherein the oscillating member of the mechanical resonator defines the braking surface.

3. The timepiece assembly according to claim 2, wherein the regulation pulse application device is arranged such that braking energy of each mechanical braking pulse is less than a locking energy, so as not to stop the mechanical resonator momentarily during the mechanical braking pulses, and wherein the oscillating member and the braking member are arranged such that the mechanical braking pulses are applied by dynamic dry friction between the braking member and the braking surface of the oscillating member.

4. The timepiece assembly according to claim 3, wherein said actuator actuates said braking member via a piezoelectric element or via an electromagnetic system.

5. The timepiece assembly according to claim 4, wherein said actuator comprises a timepiece motor, the braking member being mounted on a rotor of the timepiece motor, wherein the braking member applies pressure on the oscillating member when the rotor performs a rotation, and wherein the rotation is induced by a power supply of a motor coil in response to said control signal.

6. The timepiece assembly according to claim 3, wherein the oscillating member is formed by a pivoting balance comprising a felloe which defines said braking surface, wherein the braking surface is substantially circular, and wherein the braking member comprises a movable part which defines a braking pad and which applies pressure against the circular braking surface during the application of the mechanical braking pulses.

7. The timepiece assembly according to claim 3, wherein the oscillating member is includes a pivoting balance comprising a central shaft which bears a part, other than the felloe of the balance, which defines said braking surface, wherein said braking surface is substantially circular; and wherein the braking member comprises a movable part which defines a braking pad and which applies pressure against the circular braking surface during the application of the mechanical braking pulses.

8. The timepiece assembly according to claim 6, wherein said movable part is a first part and said braking pad is a first brake pad, wherein said braking member or another braking member also forming said actuator comprises at least a second movable part which defines a second brake pad, wherein said actuator is arranged such that, during the application of said mechanical braking pulses, the first and second brake pads apply two radial forces to the balance, and wherein the two radial forces are diametrically opposed relative to the axis of rotation of the balance.

9. The timepiece assembly according to claim 7, wherein said movable part is a first part and said braking pad is a first brake pad, wherein said braking member or another braking member also forming said actuator comprises at least a second movable part which defines a second brake pad, wherein said actuator is arranged such that, during the application of said mechanical braking pulses, the first and second brake pads apply two radial forces to the balance, and wherein the two radial forces are diametrically opposed relative to the axis of rotation of the balance.

10. The timepiece assembly according to claim 6, wherein said movable part is a first part and said braking pad is a first brake pad, wherein said braking member or another braking member also forming said actuator comprises at least a second movable part which defines a second brake pad, and wherein said actuator is arranged such that, during the application of said braking pulses, the first and second brake pads apply to the balance two substantially axial forces of opposite directions.

11. The timepiece assembly according to claim 7, wherein said movable part is a first part and said braking pad is a first brake pad, wherein said braking member or another braking member also forming said actuator comprises at least a second movable part which defines a second brake pad, and wherein said actuator is arranged such that, during the application of said braking pulses, the first and second brake pads apply to the balance two substantially axial forces of opposite directions.

12. The timepiece assembly according to claim 1, wherein each oscillation period of the mechanical oscillator has a first alternation followed by a second alternation, each first alternation and each second alternation having a passage of the mechanical resonator via the neutral position of the mechanical resonator at a median time and a duration between an initial time and an end time defined respectively by the two end positions occupied by the mechanical resonator at the start of and at the end of each alternation, respectively;

wherein said measuring device determines whether the time drift of the mechanical oscillator corresponds an advance or to a delay, wherein said control circuit and said regulation pulse application device selectively apply a first mechanical braking pulse to the mechanical resonator, when the time drift measured corresponds to said at least a certain advance, wherein at least a main part of the first mechanical braking pulse occurs between said initial time and said median time of an alternation and, wherein said control circuit and said regulation pulse application device selectively apply a second mechanical braking pulse to the mechanical resonator when the time drift measured corresponds to said delay, wherein at least a main part of the second mechanical braking pulse occurs between said median time and said end time of an alternation.

13. The timepiece assembly according to claim 3, wherein each oscillation period of the mechanical oscillator has a first alternation followed by a second alternation, each first alternation and each second alternation having a passage of the mechanical resonator via the neutral position thereof at a median time and a duration between an initial time and an end time defined respectively by the two end positions occupied by the mechanical resonator at the start of and at the end of each alternation, respectively;

wherein said measuring device determines whether the time drift of the mechanical oscillator corresponds an advance or a delay, wherein said control circuit and said regulation pulse application device selectively apply a first mechanical braking pulse to the mechanical resonator, when the time drift measured corresponds to said at least a certain advance, wherein at least a main part of the first mechanical braking pulse occurs between said initial time and said median time of an alternation, and said control circuit and said regulation pulse application device selectively apply a second mechanical braking pulse to the mechanical resonator when the time drift measured corresponds to said at least a certain delay, wherein at least a main part of the second mechanical braking pulse occurs between said median time and said end time of an alternation.

14. The timepiece assembly according to claim 12, wherein the regulation device comprises a determining device that determines time positions of the mechanical resonator, the determining device determining, a first time position which occurs prior to said median time and after said initial time of an alternation and a second time position which occurs after said median time and prior to said end time of the alternation, wherein said control circuit selectively triggers said first mechanical braking pulse at said first time and selectively triggers said second mechanical braking pulse at said second time, and wherein said braking surface of the mechanical resonator comprises a first sector, along said oscillation axis, that applies the first mechanical braking pulse starting at said first time and a second sector, along said oscillation axis, that applies the second mechanical braking pulse starting at said second time, regardless of the oscillation amplitude of said mechanical oscillator in said usable operating range of said mechanical oscillator.

15. The timepiece assembly according to claim 13, wherein the regulation device comprises a determining device that determines time positions of the mechanical resonator, the determining device determining, a first time position which occurs prior to said median time and after said initial time of an alternation and a second time which occurs after said median time and prior to said end time of the alternation;

wherein said control circuit selectively triggers said first mechanical braking pulse at said first time position and selectively triggers said second mechanical braking pulse at said second time position; and wherein said braking surface of the mechanical resonator comprises a first sector, along said oscillation axis, that applies the first mechanical braking pulse starting at said first time position and a second sector, along said oscillation axis, that applies the second mechanical braking pulse starting at said second time position regardless of the oscillation amplitude of said mechanical oscillator in said usable operating range of said mechanical oscillator.

16. The timepiece assembly according to claim 1, wherein said sensor detects the passage of the mechanical resonator via the neutral position of the mechanical resonator.

17. The timepiece assembly according to claim 14, wherein said sensor detects the passage of the mechanical resonator via the neutral position of the mechanical resonator; and wherein said determining device measures, following the detection of the passage of the resonator via the neutral position, a first time interval and a second time interval wherein the ends of the first and second time intervals define said first time position and said second time position, respectively.

18. The timepiece assembly according to claim 15, wherein said sensor detects the passage of the mechanical resonator via the neutral position of the mechanical resonator; and wherein said determining device measures, following the detection of the passage of the resonator via the neutral position, a first time interval and a second time interval wherein the ends of the first and second time intervals define said first time position and said second time position, respectively.

19. The timepiece assembly according to claim 1, wherein said sensor is either an optical sensor comprising a light source that sends a light beam towards the mechanical resonator and a light detector that receives a light signal in return, wherein an intensity of the light beam varies periodically according to the position of the mechanical resonator, or a capacitive sensor or an inductive sensor that detects a variation in capacitance or inductance, respectively, according to the position of the mechanical resonator, the inductive sensor functioning without magnetised material on the resonator.

20. The timepiece assembly according to claim 1, wherein said braking surface has an extent enabling the application of said mechanical braking pulses with a triggering of the mechanical braking pulse at any time of the respective alternations of said mechanical oscillator.

21. A module for regulating a medium frequency of a mechanical oscillator fitted in a timepiece mechanical movement, the module comprising:

a regulating device comprising an auxiliary oscillator, a regulation pulse application device that applies regulation pulses to a mechanical resonator which forms the mechanical oscillator, and an electronic control circuit that generates a control signal supplied to and which activates the regulation pulse application device; and a sensor that detects a passage of the mechanical resonator via a given position on an oscillation axis of the mechanical resonator;

wherein the regulating device comprises a measuring device that measures, on the basis of position signals supplied by said sensor, a time drift of the mechanical oscillator relative to the auxiliary oscillator, wherein the regulation pulse application device is formed by an electromechanical device that generates, in response to the control signal which is dependent on the time drift measured, mechanical braking pulses that are applied to the mechanical resonator, wherein at least one mechanical braking pulse applies a brake force on a braking surface of the mechanical resonator when a time drift of the mechanical oscillator is detected, and wherein the regulating device triggers the at least one mechanical braking pulse at a given time during an alternation of the mechanical oscillator, the given time being selected such that passage via a neutral position of the mechanical resonator does not occur during the mechanical braking pulse.

22. The module according to claim 21, wherein the regulation pulse application device includes an actuator comprising a braking member that is actuated in response to said control signal, to apply a mechanical force to the oscillating member of the mechanical resonator during said mechanical braking pulse, wherein the oscillating member includes said braking surface.

23. The module according to claim 22, wherein the braking member is arranged such that the mechanical braking pulses are applied by dynamic dry friction between said braking member and said braking surface of the oscillating member.

24. The module according to claim 23 wherein the braking member comprises a movable part which defines a brake pad that applies pressure on said braking surface during application of the mechanical braking pulses.

25. The module according to claim 24, wherein said movable part is a first part and said brake pad is a first brake pad, wherein said braking member or another braking member also forming said actuator comprises a second movable part which defines a second brake pad, and wherein said actuator is arranged such that, during the application of said mechanical braking pulses, the first and second brake pads apply to the mechanical resonator two substantially aligned forces of opposite directions.

* * * * *